US011801968B2

(12) United States Patent
Sanbar

(10) Patent No.: US 11,801,968 B2
(45) Date of Patent: Oct. 31, 2023

(54) RESEALABLE CONTAINER

(71) Applicant: Cool Gear International, LLC, Plymouth, MA (US)

(72) Inventor: Fadi Sanbar, Billerica, MA (US)

(73) Assignee: Cool Gear International, LLC, Plymouth, MA (US)

( * ) Notice: Subject to any disclaimer, the term of this patent is extended or adjusted under 35 U.S.C. 154(b) by 90 days.

(21) Appl. No.: 17/231,448

(22) Filed: Apr. 15, 2021

(65) Prior Publication Data

US 2021/0229860 A1 Jul. 29, 2021

Related U.S. Application Data

(62) Division of application No. 16/082,022, filed as application No. PCT/US2017/020606 on Mar. 3, 2017, now Pat. No. 11,014,707.

(60) Provisional application No. 62/303,953, filed on Mar. 4, 2016.

(51) Int. Cl.

| | |
|---|---|
| ***B65D 47/24*** | (2006.01) |
| ***B65D 17/28*** | (2006.01) |
| ***A45F 3/18*** | (2006.01) |

(52) U.S. Cl.

CPC ..... *B65D 17/4014* (2018.01); *A45F 3/18* (2013.01); *B65D 47/249* (2013.01)

(58) Field of Classification Search

CPC ..... B65D 47/248; B65D 47/249; B65D 2543/00046; B65D 43/265; B65D 17/4014; B65D 43/16; A47G 19/2266; A47G 19/2272

USPC ..... 220/254.5, 254.3, 714, 715, 265, 260, 220/270, 254.1

See application file for complete search history.

(56) References Cited

U.S. PATENT DOCUMENTS

| | | | | |
|---|---|---|---|---|
| 3,807,597 | A | 4/1974 | Wells et al. | |
| 3,910,453 | A | 10/1975 | Kneusel et al. | |
| 4,429,804 | A | 2/1984 | Pease | |
| 4,681,238 | A | 7/1987 | Sanchez | |
| 5,035,343 | A | 7/1991 | Morton | |
| 5,199,591 | A | 4/1993 | Thibeault et al. | |
| 5,246,145 | A | 9/1993 | Leoncavallo et al. | |
| 5,894,950 | A | 4/1999 | Kick | |
| 6,098,830 | A | 8/2000 | Jamieson | |
| 6,685,055 | B2 | 2/2004 | Taylor | |
| 7,891,517 | B2 | 2/2011 | Simmons | |
| 8,215,513 | B1 | 7/2012 | Grissom | |
| 8,297,462 | B1 * | 10/2012 | Joyce | B65D 51/242 215/396 |

(Continued)

FOREIGN PATENT DOCUMENTS

| | | |
|---|---|---|
| CN | 200978079 | 11/2007 |
| CN | 201131575 | 10/2008 |

(Continued)

OTHER PUBLICATIONS

Extended European Search Report issued in EP 17760879, dated Feb. 12, 2020, 8 pages, European Patent Office, Munich, Germany.

(Continued)

*Primary Examiner* — James N Smalley
*Assistant Examiner* — Madison L Poos
(74) *Attorney, Agent, or Firm* — Dinsmore & Shohl LLP

(57) ABSTRACT

The disclosure provides a container including a reseal-able closure mechanism having a rocker arm and a pull tab or actuator button.

10 Claims, 17 Drawing Sheets

(56) References Cited

U.S. PATENT DOCUMENTS

| | | | | |
|---|---|---|---|---|
| 8,376,162 | B2 * | 2/2013 | Yang | B65D 47/249 220/717 |
| 8,616,399 | B2 | 12/2013 | Milkowski et al. | |
| 8,651,318 | B2 | 2/2014 | Brandtner | |
| 8,783,493 | B2 | 7/2014 | Lucas et al. | |
| 8,833,586 | B2 | 9/2014 | Meyers et al. | |
| 8,844,744 | B2 | 9/2014 | Lucas | |
| 8,844,761 | B2 | 9/2014 | Zabaleta et al. | |
| 8,939,324 | B2 | 1/2015 | Azodi et al. | |
| 2004/0159665 | A1 | 8/2004 | Morrissey et al. | |
| 2007/0164026 | A1 | 7/2007 | Morrissey et al. | |
| 2009/0026201 | A1 | 1/2009 | Hall et al. | |
| 2011/0315684 | A1 | 12/2011 | Bratsch | |
| 2012/0012586 | A1 | 1/2012 | Rinderer et al. | |
| 2013/0228586 | A1 | 9/2013 | Schandl | |
| 2013/0320013 | A1 | 12/2013 | Bratsch | |
| 2015/0083724 | A1 | 3/2015 | Lagace et al. | |
| 2015/0164255 | A1 | 6/2015 | Coon et al. | |
| 2015/0197366 | A1 | 7/2015 | Chapin | |

FOREIGN PATENT DOCUMENTS

| | | | |
|---|---|---|---|
| CN | 101574219 | | 11/2009 |
| CN | 01910010 | | 12/2010 |
| EP | 1247752 | | 10/2002 |
| FR | 2970239 | | 7/2012 |
| JP | 2003-054594 | A | 2/2003 |
| JP | 2013-523548 | A | 6/2013 |
| JP | 2014-505640 | A | 3/2014 |
| KR | 20-0469736 | | 11/2013 |

OTHER PUBLICATIONS

International Preliminary Report on Patentability issued in PCT application No. PCT/US2017/020606, dated Sep. 4, 2018.
Chinese Office Action dated Aug. 2, 2019 in corresponding Chinese Patent Application No. 201780027655.
Australian Patent Application No. 2017226178 titled "Resealable container" filed on Mar. 3, 2017.
First Examination Report for Australian Patent Application No. 2017226178 dated Jul. 26, 2021.
Second Examination Report for Australian Patent Application No. 2017226178 dated Jan. 10, 2022.
Third Examination Report for Australian Patent Application No. 2017226178 dated Jun. 30, 2022.
Canadian Patent Application No. 3016564 titled "Resealable container" filed on Aug. 31, 2018.
China Patent Application No. 201780027655.X titled "Resealable container" filed on Nov. 2, 2018.
European Patent Application No. 17760879.1 titled "Resealable container" filed on Oct. 4, 2018.
Intention to Grant for European Patent Application No. 17760879.1 dated Jun. 1, 2022.
Japanese Patent Application No. 2018-546541 titled "Resealable container" filed on Mar. 3, 2017.
Search Report for Japanese Patent Application No. 2018-546541 dated Nov. 13, 2020.
Notice of Reasons for Refusal for Japanese Patent Application No. 2018-546541 dated Dec. 1, 2020.
Decision to Grant for Japanese Patent Application No. 2018-546541 dated Jul. 27, 2021.
Korean Patent Application No. 10-2018-7028657 titled "Resealable container" filed on Mar. 3, 2017.
Written Opinion for Korean Patent Application No. 10-2018-7028657 dated Apr. 25, 2022.
Mexican Patent Application No. MX/a/2018/010641 titled "Resealable container" filed on Mar. 3, 2017.
PCT Patent Application No. PCT/US2017/020606 titled "Resealable container" filed on Mar. 3, 2017.
International Search Report and Written Opinion PCT Patent Application No. PCT/US2017/020606 dated Jun. 29, 2017.
U.S. Appl. No. 62/303,953 titled "Resealable container" filed Mar. 4, 2016.
U.S. Appl. No. 16/082,022 titled "Resealable container" filed Sep. 4, 2018.
Restriction Requirement for U.S. Appl. No. 16/082,022 dated Jul. 2, 2020.
Non-Final Office Action for U.S. Appl. No. 16/082,022 dated Sep. 16, 2020.
Notice of Allowance for U.S. Appl. No. 16/082,022 dated Jan. 22, 2021.

* cited by examiner

RESEALABLE CONTAINER

RELATED APPLICATIONS

This application is a divisional of and claims benefit of U.S. patent application Ser. No. 16/082,022, filed Sep. 4, 2018, which is a U.S. National Phase application under 35 U.S.C. § 371 of PCT Application No. PCT/US2017/020606, filed Mar. 3, 2017, which claims the benefit of priority under 35 U.S.C. § 119(e) to U.S. Provisional Application No. 62/303,953, filed Mar. 4, 2016, each of which is incorporated herein by reference in its entirety.

FIELD OF THE DISCLOSURE

This disclosure relates to container caps, and more particularly, to containers with a resealable closure mechanism.

BACKGROUND

Generally, containers may include a mechanism for opening and closing an aperture through which fluid may enter and/or exit the container (e.g., a screw-on cap, a flip cap, etc.). To access the fluid within the container, a user would typically move or remove a portion of the cap or lid relative to the aperture of the container, so that a fluid path into the container may be provided and/or accessed. Solutions for providing improved resealable closure mechanisms are needed.

SUMMARY OF THE INVENTION

In an aspect, the present disclosure provides a resealable cap for a container, that includes a cap cover having an opening; and a resealable closure mechanism including an actuator tab, a rocker arm post, and a rocker arm, wherein the rocker arm post has a first end connected to the actuator tab and a second end connected to the rocker arm, and the second end of the rocker arm is configured to mate with the opening in the cap cover when the actuator tab is in an un-actuated position.

In an embodiment, the actuator tab is a pull tab.

In an embodiment, the second end of the rocker arm is covered by a mouthpiece plug.

In an embodiment, the mouthpiece plug is made of a material selected from the group consisting of rubber, plastic, soft plastic, foam, and silicone.

In an embodiment, the rocker arm post includes a detent. In an embodiment, the detent is configured to mate with a detent groove positioned in the cap cover when the actuator tab is in the un-actuated position.

In an embodiment, the cap cover has a top edge configured to house the actuator tab and a bottom edge configured to mate with a container.

In an embodiment, the top edge of the cap cover is configured to house the actuator tab in a recessed opening.

In an embodiment, the opening is positioned between the actuator tab and a peripheral edge of the cap cover.

In an aspect, the present disclosure provides a resealable cap for a container, that includes a cap cover having an opening; and a resealable closure mechanism including an push button tab, an actuator post, a spring, an O-ring, a rocker arm having a distal rocker arm end configured to resealably mate with the opening in the cap cover, and a locking cap member, wherein the actuator post passes through the cap cover and has a first end configured to interact with the push button tab and a second end configured to slide through the rocker arm and mate with the locking cap member, thereby retaining the rocker arm on the second end of the actuator post, and the spring and O-ring are positioned on the actuator post between the rocker arm and the push button tab.

In an embodiment, the push button tab alternates between an actuated position and an un-actuated position.

In an embodiment, the second end of the rocker arm is covered by a mouthpiece plug.

In an embodiment, the mouthpiece plug is made of a material selected from the group consisting of rubber, plastic, soft plastic, foam, and silicone.

In an embodiment, the push button tab includes a detent.

In an embodiment, the detent is configured to mate with a detent groove positioned in the cap cover when the push button tab is in the un-actuated position.

In an embodiment, the cap cover has a top edge configured to house the push button tab and a bottom edge configured to mate with a container.

In an embodiment, the spring has a first spring end that abuts a flanged portion of the first end of the actuator post and a second spring end that seats against a top portion of the cap cover.

In an embodiment, the spring is compressed when the push button tab is in the actuated position and uncompressed when the push button tab is in the un-actuated position.

In an embodiment, the distal rocker arm and is positioned away from the opening when the push button tab is in the actuated position in the spring is compressed.

DEFINITIONS

Hereinafter reference will now be made in detail to various embodiments of the subject disclosure, examples of which are illustrated in the accompanying drawings and described below. While example embodiments are described, it will be understood that the present disclosure is not limited to those exemplary embodiments. On the contrary, this disclosure covers not only the embodiments described herein, but also various alternatives, modifications, equivalents and other embodiments, which may be included within the spirit and scope of the disclosure.

Ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "about" is understood as within a range of normal tolerance in the art, for example within 2 standard deviations of the mean. "About" may be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

As used herein, the singular form "a", "an" and "the" include plural references unless the context clearly dictates otherwise.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

Figure 1:
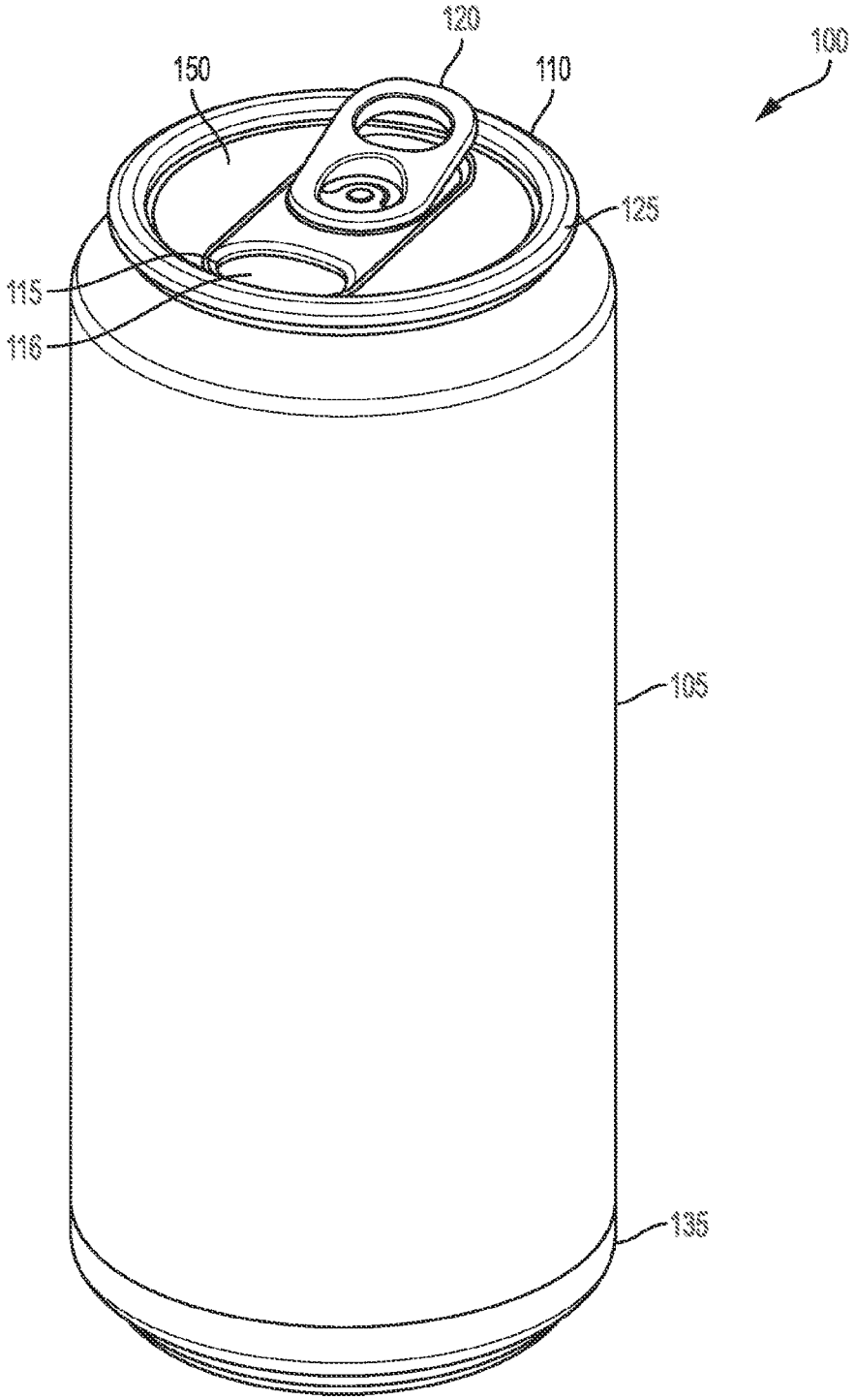
FIG. 1 provides a perspective view of a resealable container according to an exemplary embodiment of the invention.
Figure 2:
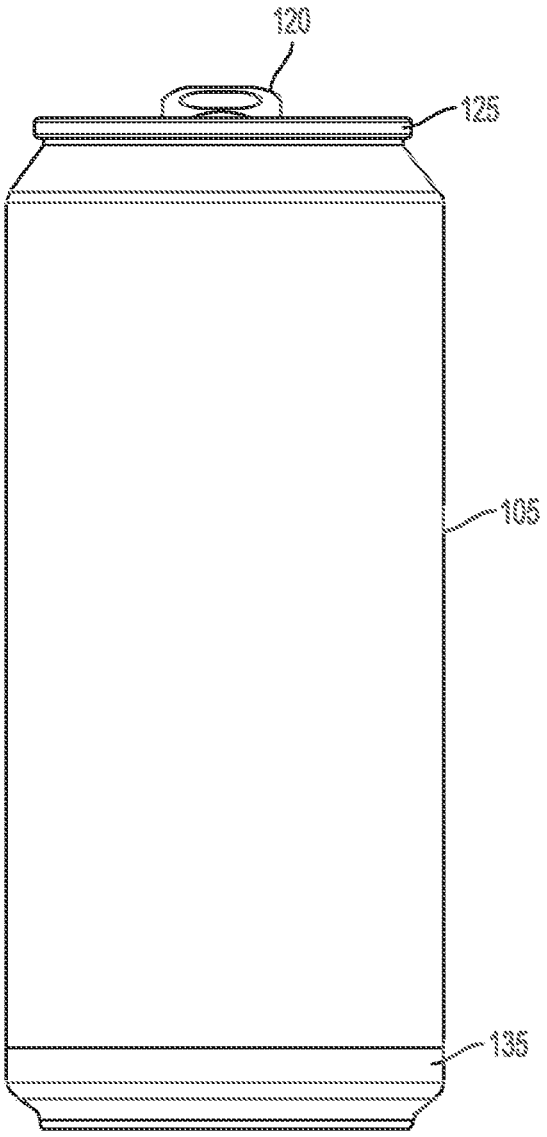
FIG. 2 provides a front view of a resealable container according to an exemplary embodiment of the invention.
Figure 3:
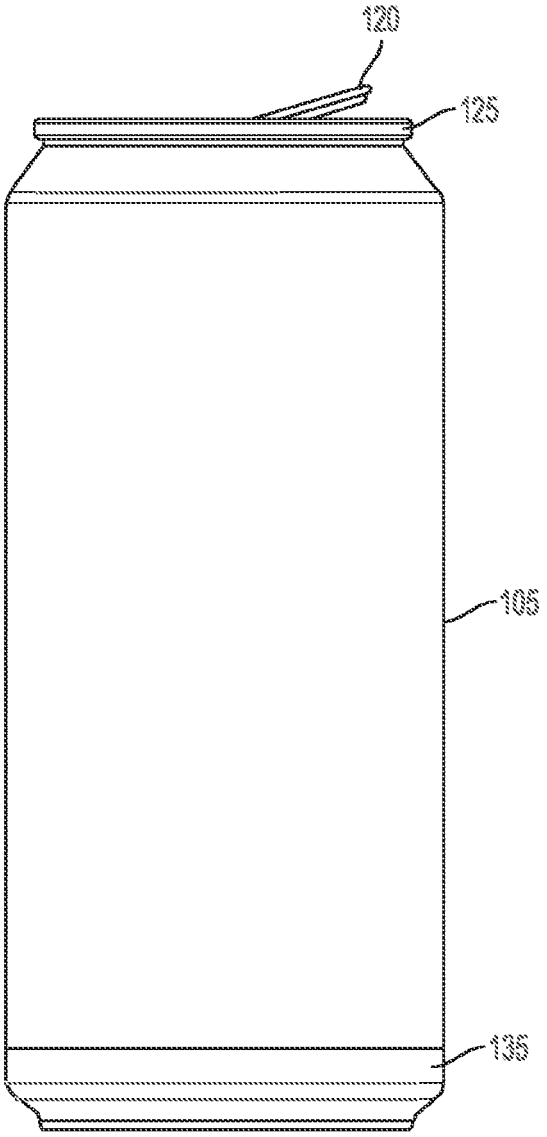
FIG. 3 provides a right side view of a resealable container according to an exemplary embodiment of the invention.
Figure 4:
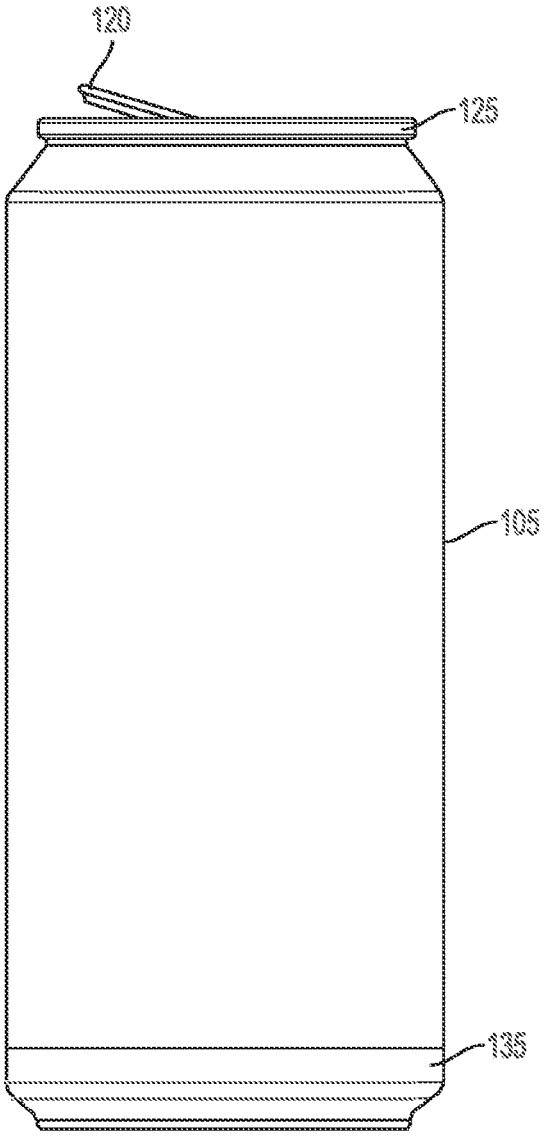
FIG. 4 provides a left side view of a resealable container according to an exemplary embodiment of the invention.
Figure 5:
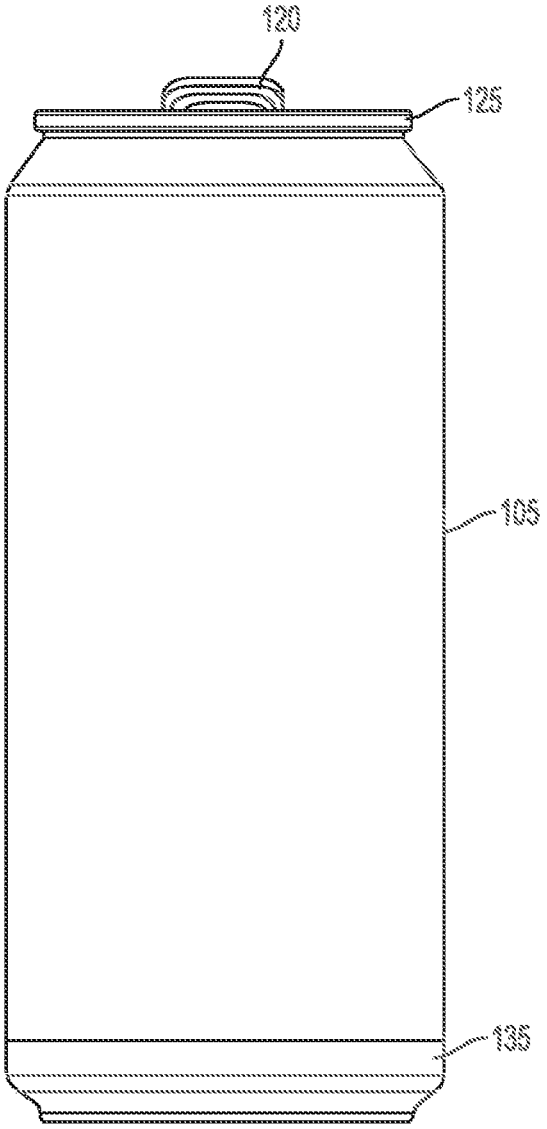
FIG. 5 provides a back view of a resealable container according to an exemplary embodiment of the invention.
Figure 6:
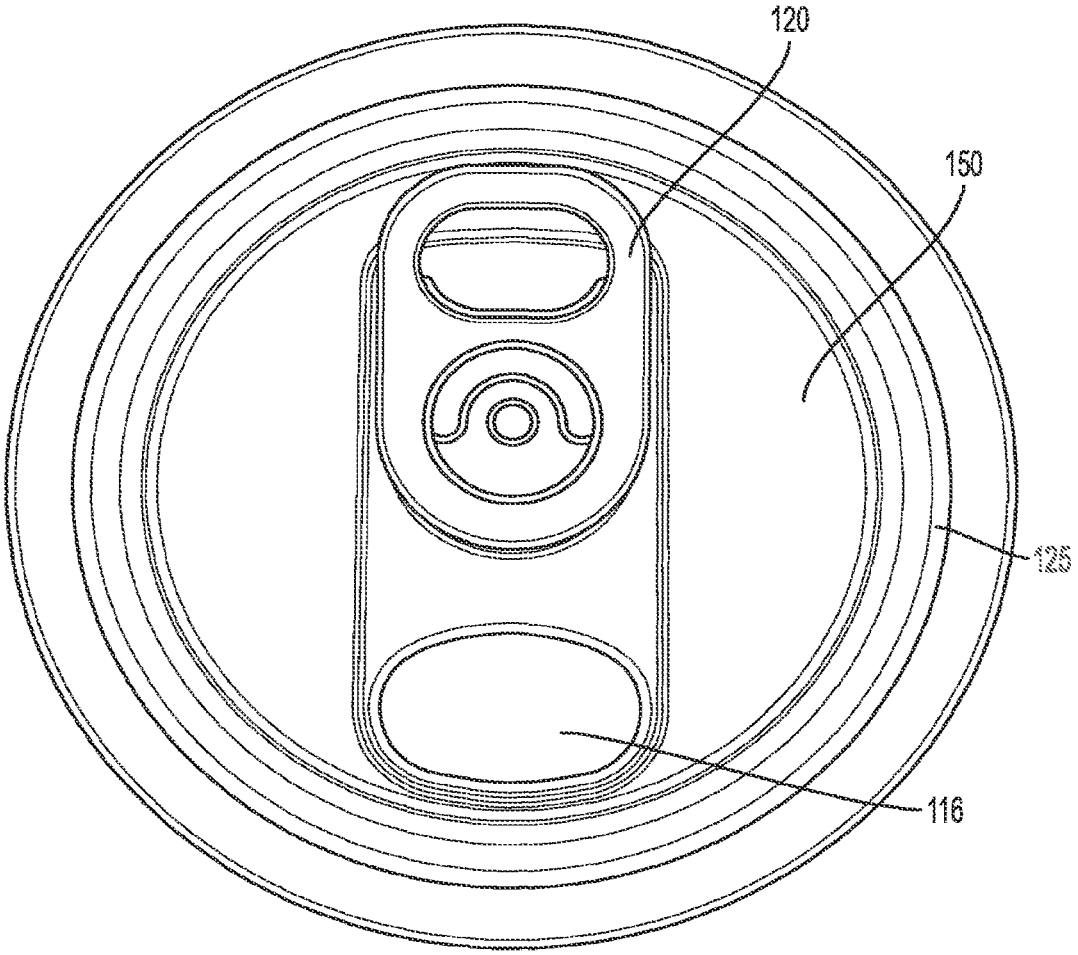
FIG. 6 provides a top view of a resealable container according to an exemplary embodiment of the invention.
Figure 7:
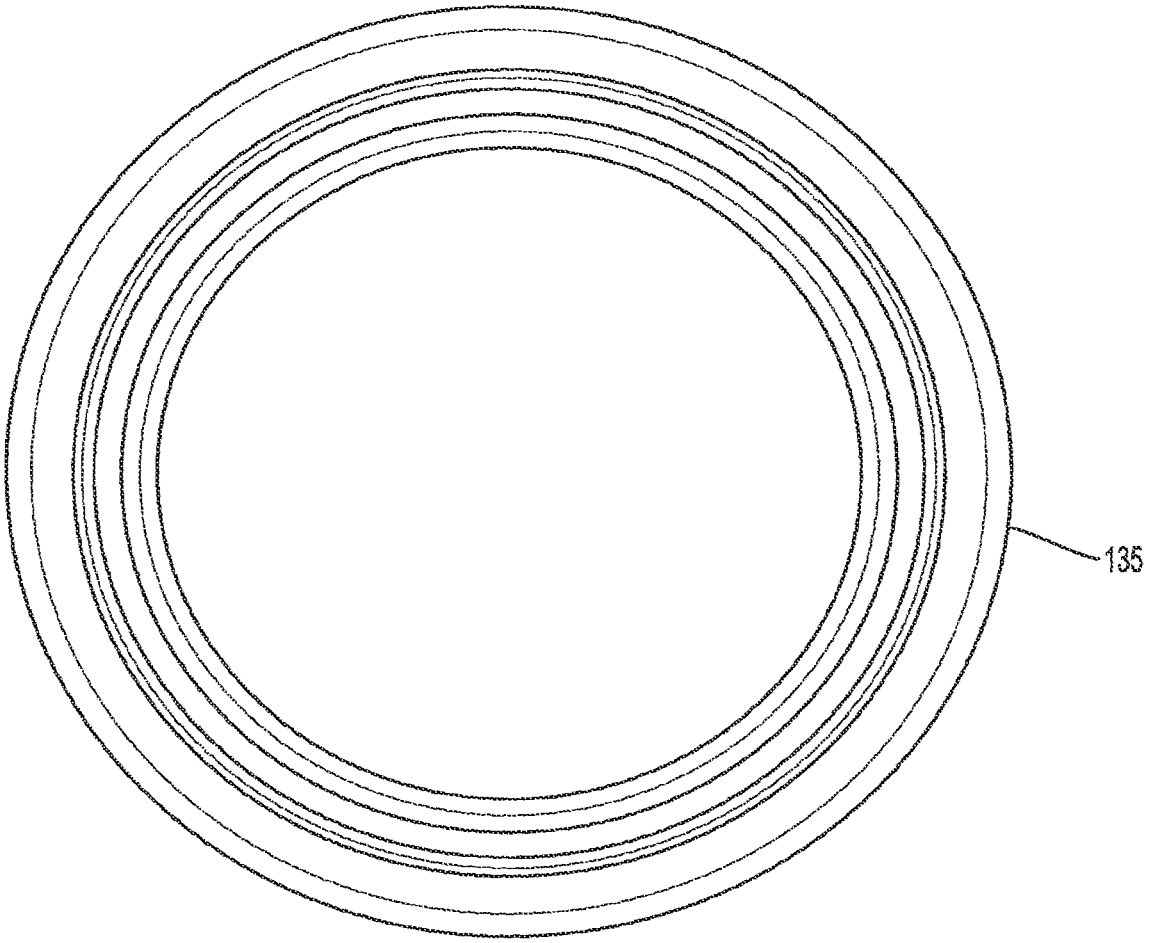
FIG. 7 provides a bottom view of a resealable container according to an exemplary embodiment of the invention.

The present disclosure provides a container with resealable closure mechanism capabilities. In particular, a resealable container according to an exemplary embodiment of the disclosure may include a beverage container or a sports container. The present disclosure is based, at least in part, on the discovery of a resealable closure mechanism such that fluid leakage is minimized. Reference will now be made to the drawings wherein like reference numerals identify similar structural aspects of the subject disclosure.

Referring now to FIGS. 1-7, a resealable container 100 may include a container 105, a cap assembly 110, and a container base 135. Cap assembly 110 may be removeably connected to container 105 via a number of mechanisms including, but not limited to a threaded connection, a twist lock connection, a snap fit connection and the like. Similarly, container base 135 may be connected to container 105 via a number of different mechanisms (e.g., to a threaded connection, a twist lock connection, a snap fit connection and the like). Cap assembly 110 may include a cap cover plate 150, a lip 125, and an opening 115. Container 100 may be any suitable container (e.g., a bottle, a sports bottle, a thermos, and the like). Container 100 of the present disclosure may include a resealable closure mechanism 155 (see FIG. 8), which may include pull tab 120 and mouthpiece plug 116. Pull tab 120 may be of any suitable material including, but not limited to, polypropylene. Opening 115 may be of any suitable shape including, but not limited to, a circle, an oval, and an ellipse. Additionally, opening 115 may be positioned in any suitable location. In one illustrative embodiment, opening 115 may be directly positioned in front of pull tab 120.

Any and all portions of resealable container 100 described herein may be made of any suitable material such as, but not limited to, plastic, metal, ceramic, or combinations thereof. Plastics of the present disclosure may include, for example, polyethylene terephthalate (PET), high density polyethylene, low density polyethylene, vinyl, polypropylene, and polystyrene. Additionally, suitable metals of the present disclosure may include aluminum and iron (e.g., steel, stainless steel, and cast iron). Any seal herein disclosed may be made of any suitable sealing material such as, but not limited to rubber, plastic, soft plastic and/or foam. Container 105 may include any suitable shape and design.

Figure 8:
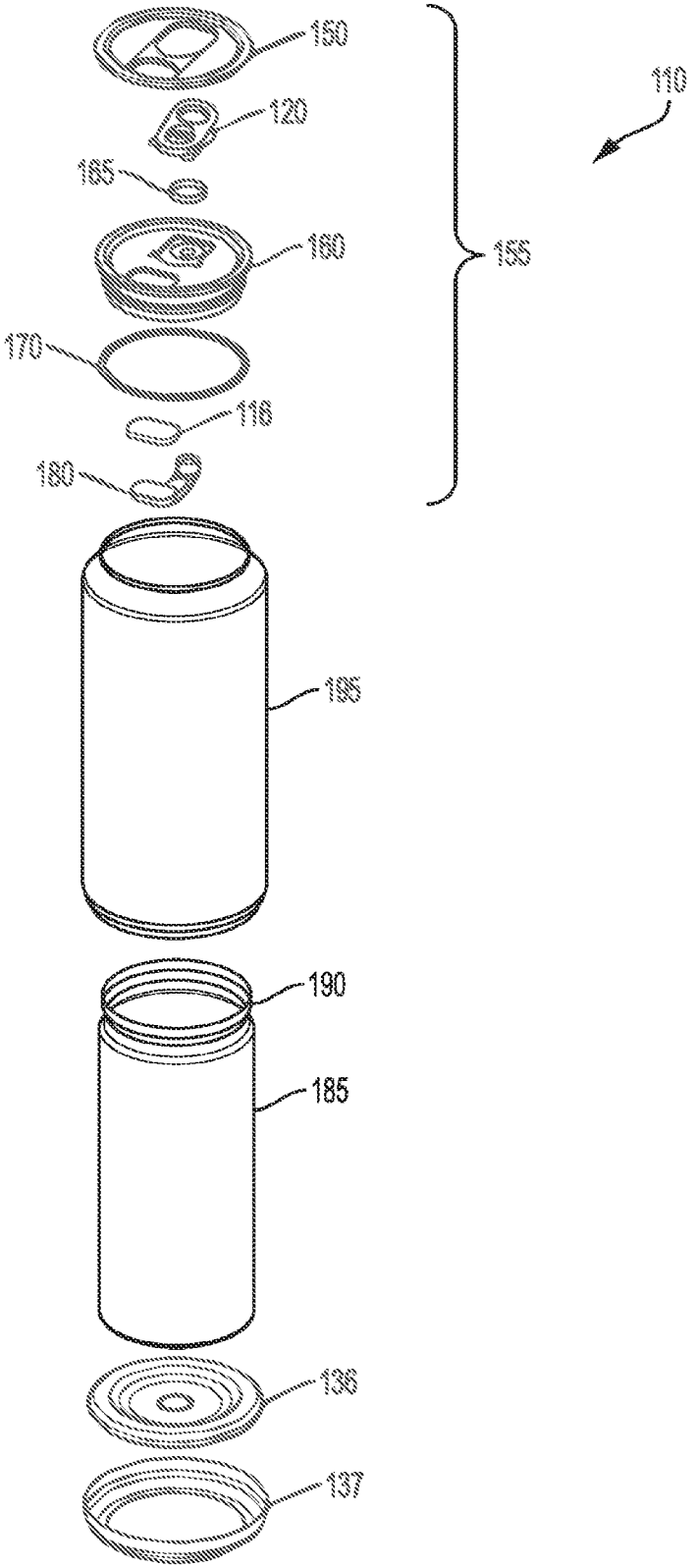
FIG. 8 provides an exploded view of a resealable container according to an exemplary embodiment of the invention.
Figure 9:
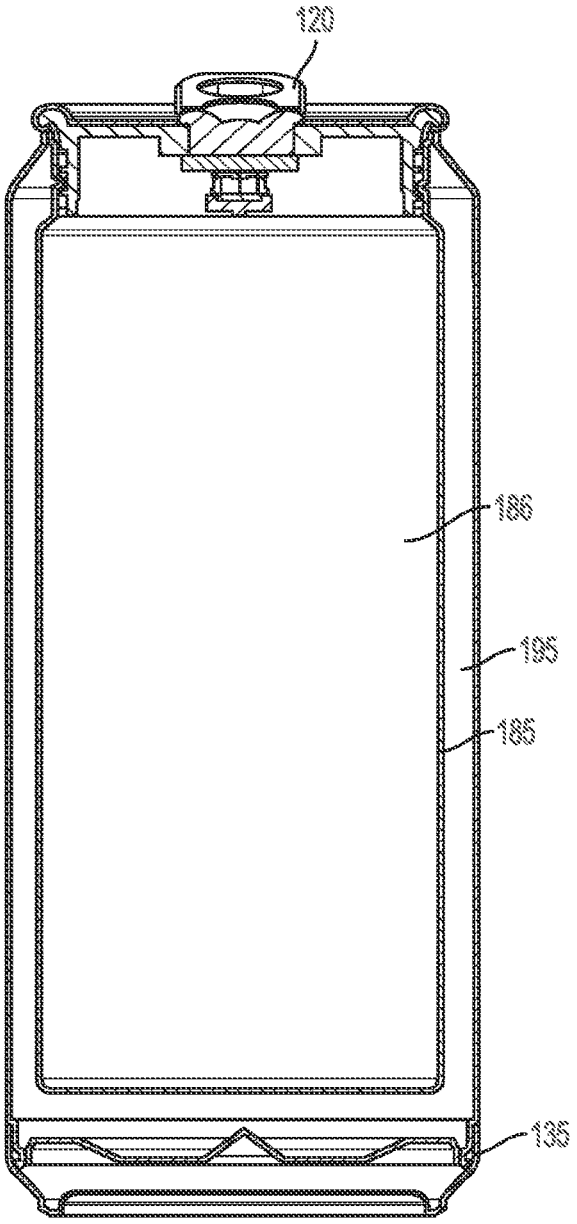
FIG. 9 provides a cross-sectional front view of a resealable container according to an exemplary embodiment of the invention.
Figure 10:
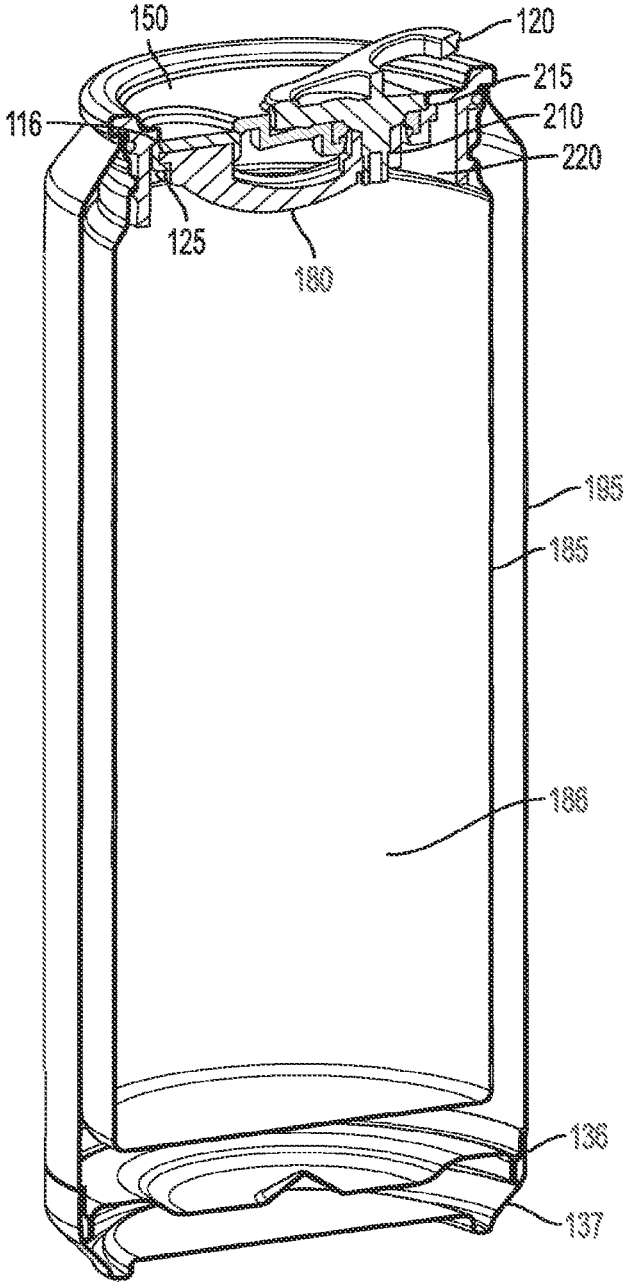
FIG. 10 provides a cross-sectional right side view of a resealable container according to an exemplary embodiment of the invention.

Referring now to FIGS. 8-10, a detailed description of resealable closure mechanism 155 is provided. FIG. 8 depicts an exploded view of resealable container 100. Notably, each of these components may be individually constructed (e.g., via known molding techniques), constructed in various combinations, or constructed as a one piece design (e.g., via 3-D printing or by other similar molding techniques). Resealable closure mechanism 155 may include a cap cover plate 150, a pull tab 120, a mouthpiece plug 116, an O-ring 165 or other elastomeric material that can minimize leaks around mouthpiece plug 116, a top end cap fastener 160, a cap sealing ring 170, and a rocker arm 180. Top end cap fastener 160 may be connected to cap cover plate 150 and to bottom end cap fastener 190 via a number of mechanisms, including, but not limited to a threaded connection, a twist lock connection, a snap fit connection and the like.

In some embodiments, sealing ring 170 is a single piece formed from a flexible and preferably food-safe material such as silicone. In other embodiments, multiple materials can be utilized to selectively promote stiffness in some regions and flexibility in other regions.

Resealable container 100 may, in some embodiments, include an outer wall 195 and an inner wall 185. The inner wall 185 may include bottom end cap fastener 190, which in some embodiments, may be configured to mate with a top end cap fastener 160 of resealable closure mechanism 155 via a number of suitable mechanisms (e.g., a threaded connection, a twist lock connection, a snap fit connection and the like). In some embodiments, the inner wall 185 may be made of any suitable material, including, for example, but not limited to stainless steel, aluminum and the like. In other embodiments, resealable container 100 may include a container base plate 136, and a container base cover 137.

Referring now to FIG. 9, a cross-section front view of resealable container 100 is provided. As seen in the cross-sectional view, container 105 may, in some embodiments, be a double-walled container having an outer wall 195 and an inner wall 185. Container 105 may include a defining a volume 186 there between. In an exemplary embodiment, defining volume 186 may be sized to hold 4 oz, 8 oz, 16 oz, 24 oz, 32 oz, etc. One of skill in the art will appreciate that the size of the reservoir may be scaled up or down to suit a particular application.

Referring now to FIG. 10, a cross-section side view of resealable container 100 is provided. In the cross-sectional side view, resealable closure mechanism 155 is more clearly seen, and may include a rocker arm support 220, a rocker arm engaging post 210, a detent 215, and a detent groove 225 (see FIG. 12).

Figure 11:
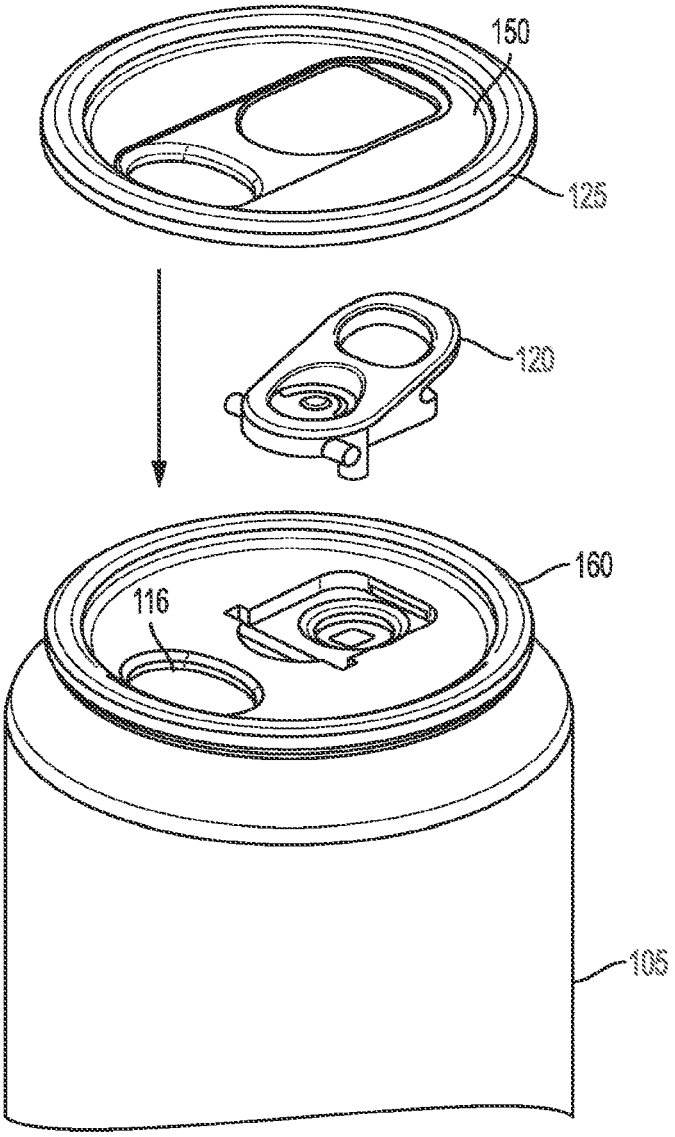
FIG. 11 provides an exploded view of the cap assembly of the resealable container according to an exemplary embodiment of the invention.

Referring now to FIG. 11, an exploded view of cap assembly 110, pull tab 120, and mouthpiece plug 116 is provided. Cap cover plate 150 may be connected to bottom end cap fastener 190 via a number of mechanisms, including, but not limited to a threaded connection, a twist lock connection, a snap fit connection and the like.

Figure 12:
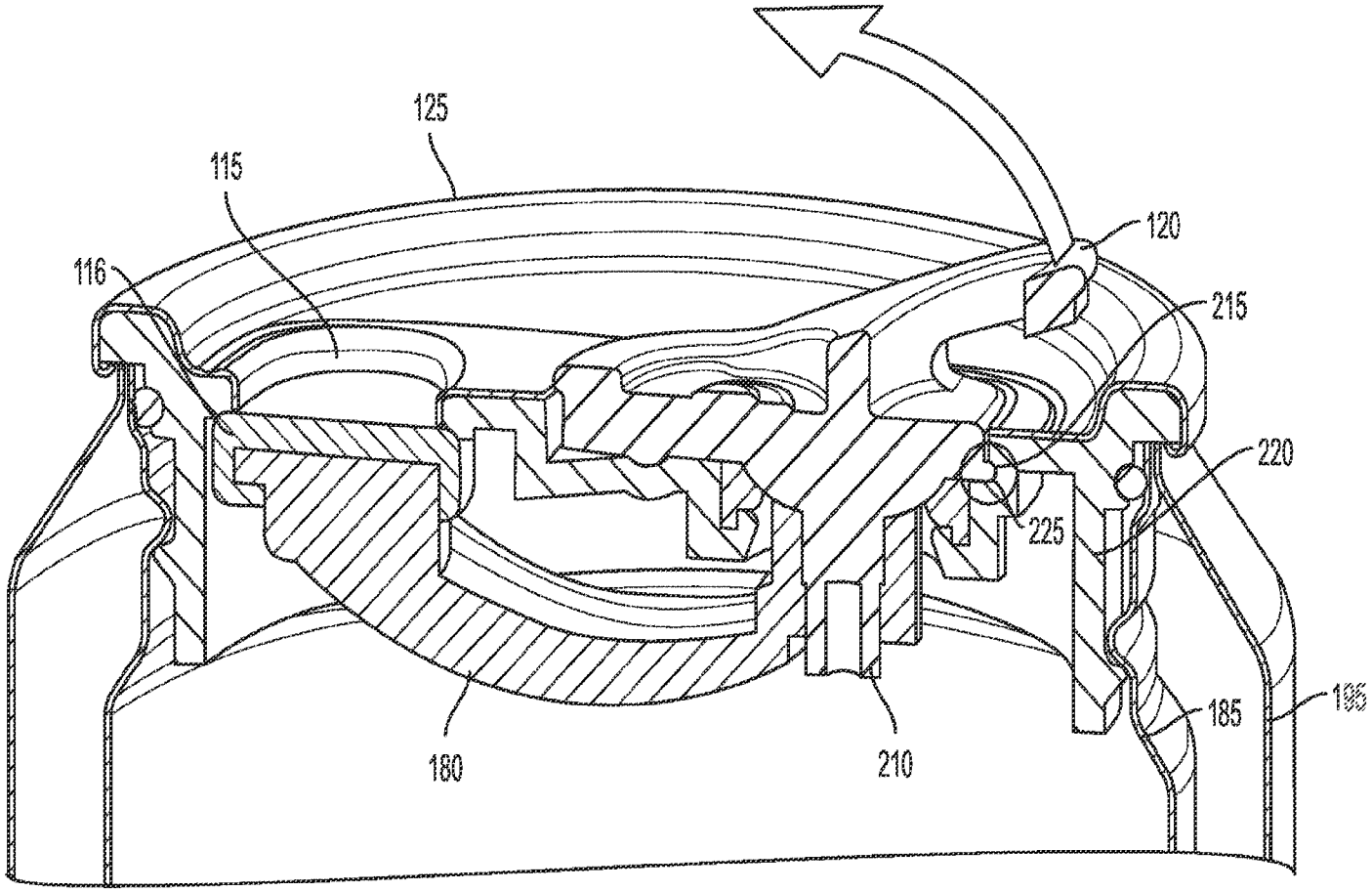
FIG. 12 provides a partial cross-sectional view of the resealable container in the closed position after being allowed to be released from the open position, according to an exemplary embodiment of the invention.

Referring now to FIG. 12, a cross-section closed view of resealable closure mechanism 155 is provided. In FIG. 12, resealable closure mechanism 155 is presented in a locked/closed/sealed position. As seen more clearly in the cross-sectional view, rocker arm 180 may be connected to pull tab 120 via a rocker arm engaging post 210. The rocker arm engaging post 210 may be configured to engage with the rocker arm 180, whereas opposite end of rocker arm 180 may be configured to engage with mouthpiece plug 116, and thereby engage with opening 115. Pull tab 120 may be locked in a closed position by detent 215 on pull tab 120. Detent groove 225 may be positioned into a rocker arm support 220 at a detent groove 225. In the cross-sectional closed view, the mouthpiece plug 116 may be engaged with the opening 115 to form a seal, thereby minimizing leakage.

Figure 13:
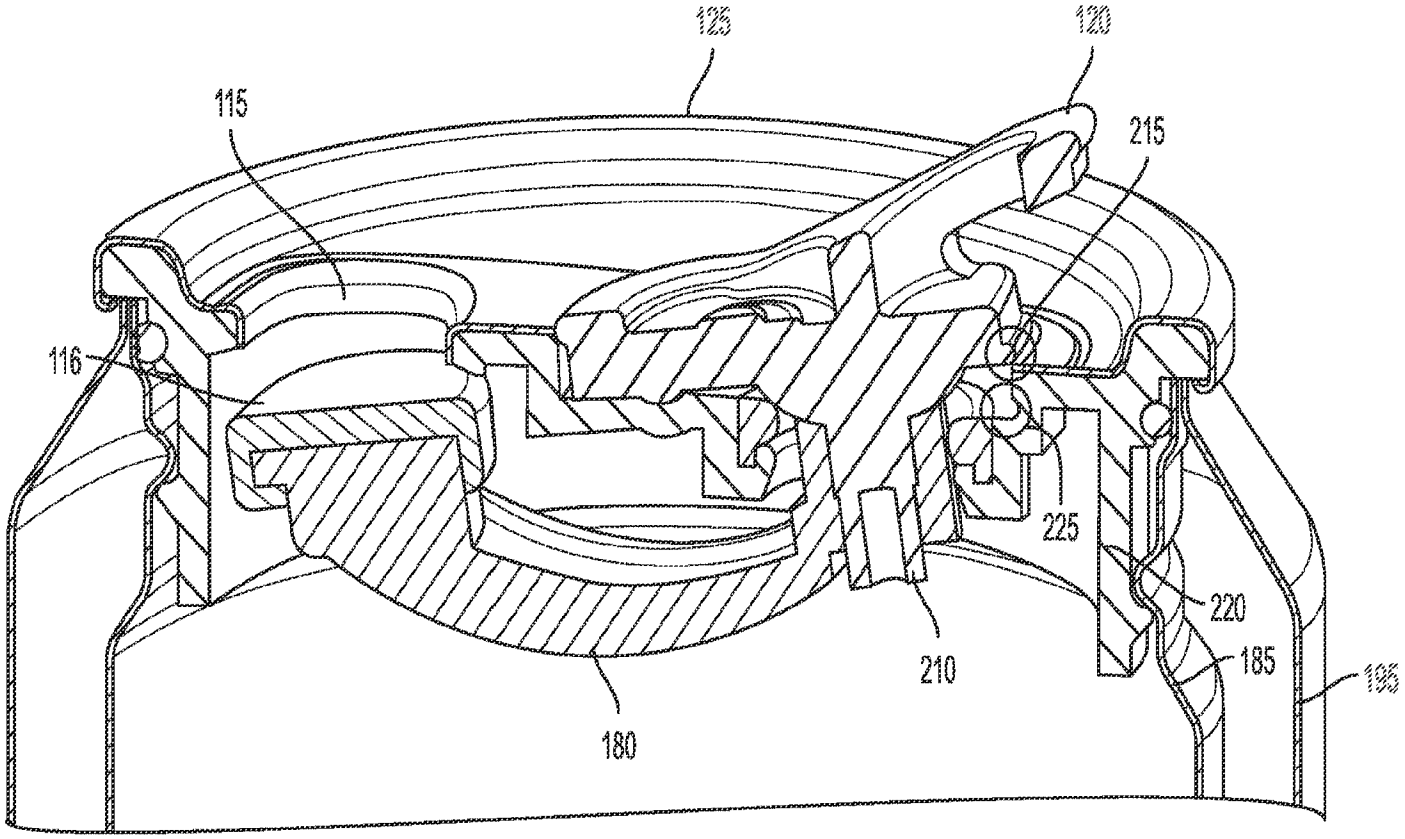
FIG. 13 provides a partial cross-sectional view of the resealable container just after being released to an open position from a closed position according to an exemplary embodiment of the invention.

Referring now to FIG. 13, a cross-section open view of resealable closure mechanism 155 is provided. In FIG. 13, resealable closure mechanism 155 is presented in an unlocked/unsealed/open position. As seen more clearly in the cross-sectional view, rocker arm 180 may be engaged with pull tab 120 via rocker arm engaging post 210. Pull tab 120 may pulled by a user to an open/unlocked position; whereby detent 215 on pull tab 120 is released from the detent groove 225, thus allowing the rocker arm 180 to pivot such that mouthpiece plug 116 is not engaged with opening 115. In the cross-sectional open views mouthpiece plug 116 may not be engaged with the opening 115, therefore allowing fluid to flow from container 105 to be provided and/or accessed. The user may push pull tab 120 towards the cap cover plate 150 to engage the detent 215 with the detent groove 225, thereby engaging the mouthpiece 116 with the opening 115 and locking the resealable closure mechanism 155.

In additional embodiments, a portion of the cap assembly 110 and resealable closure mechanism 155 may be removable (e.g., by a screw mechanism) from the base (e.g., for washing, changing, etc.)

Figure 14A:
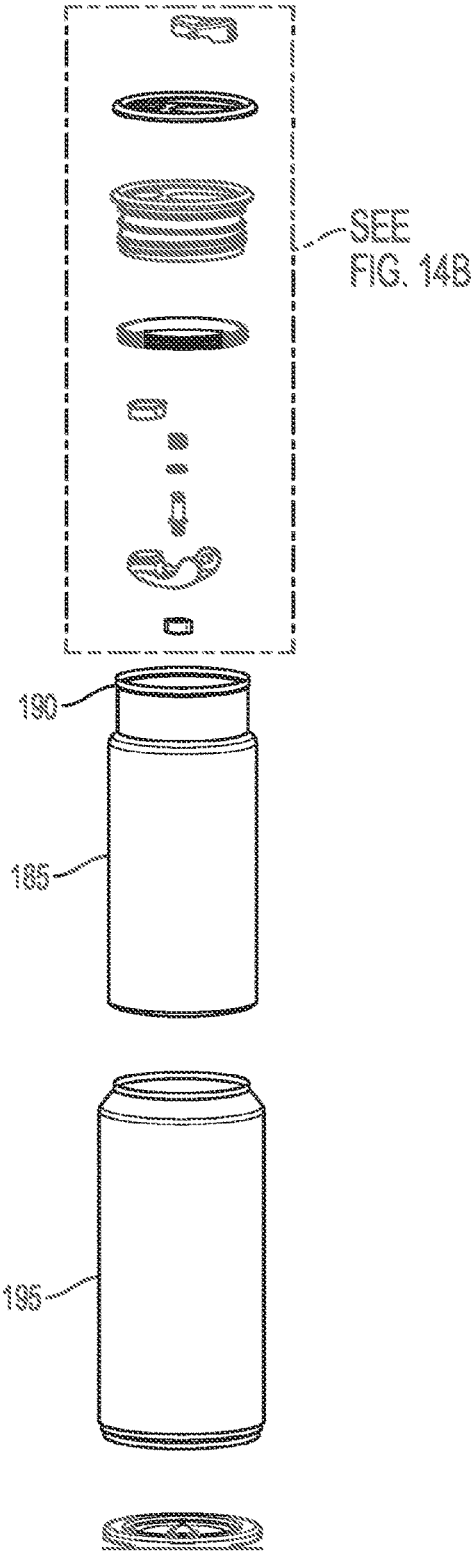
FIGS. 14A and 14B provide an exploded view of an alternative embodiment of the resealable container according to an exemplary embodiment of the invention.
Figure 14B:
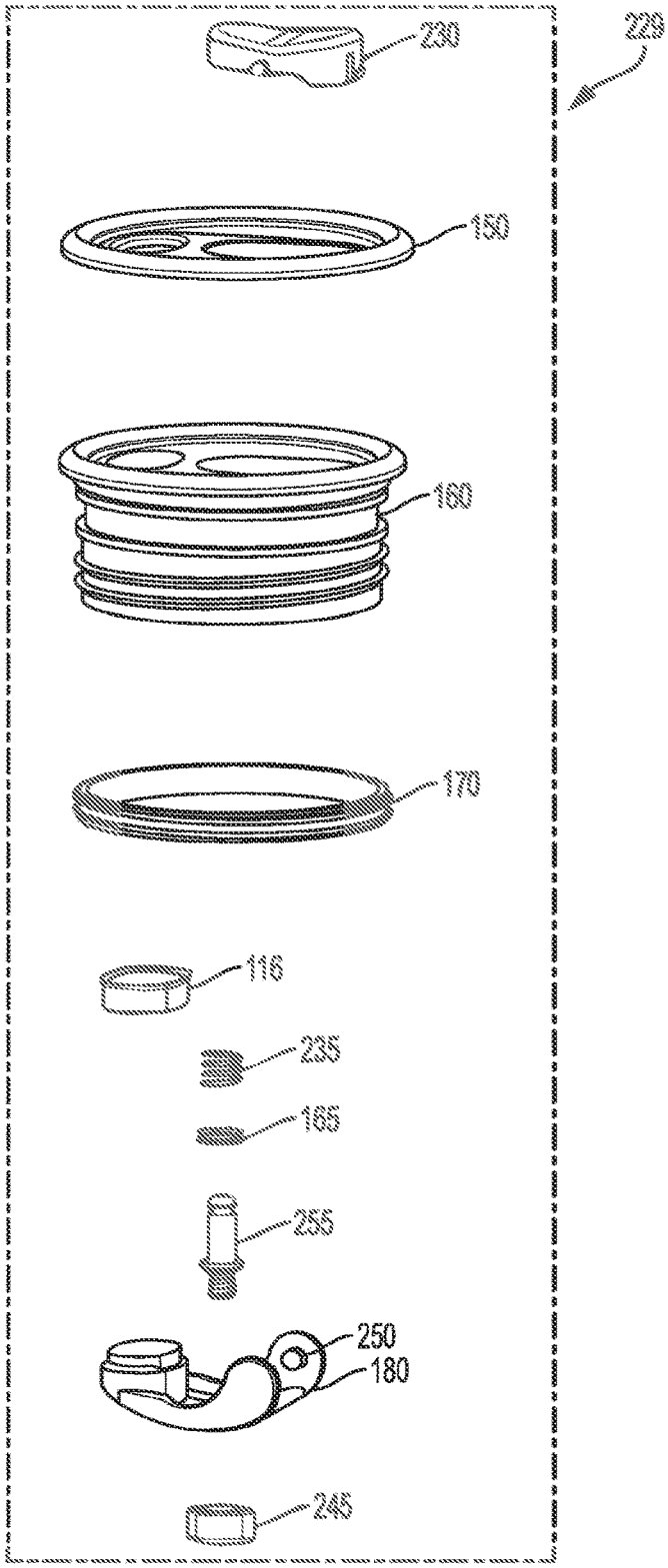

Now referring to FIG. 14, an exploded view of alternative embodiment 229 of the present disclosure in which the pull tab is replaced by a push button actuator. Notably, each of these components may be individually constructed (e.g., via known molding techniques), constructed in various combinations, or constructed as a one piece design (e.g., via 3-D printing or by other similar molding techniques). Alternative embodiment 229 of container 100 may include a push button 230, a cap cover plate 150, a top end cap fastener 160, a cap sealing ring 170, mouthpiece 116, a spring 235, an O-ring 165, an actuator 240, a rocker arm 180, a hinge pivot point 250, and a locking end cap member 245. Rocker arm 180 may include hinge pivot point 250. Top end cap fastener 160 may be connected to bottom end cap fastener 190 via a number of mechanisms including, but not limited to a threaded connection, a twist lock connection, a snap fit connection and the like. Spring 235 of the present disclosure may be a helical or coil spring designed for compression and/or tension. Material for spring 235 may include any combination of materials (e.g., metal, plastic, ceramics, or combinations thereof). Push button 230 may be made of a number of suitable materials, including, but not limited to plastic, metal, or combinations thereof. Actuator 255 may be threaded such that locking end cap member 245 may connect to actuator 240 via a screw mechanism.

Any and all portions of alternative embodiment 229 of resealable container 100 described herein may be made of any suitable material such as, but not limited to, plastic, metal, ceramic, or combinations thereof. Plastics of the present disclosure may include, for example, polyethylene terephthalate (PET), high density polyethylene, low density polyethylene, vinyl, polypropylene, and polystyrene. Additionally, suitable metals of the present disclosure may include aluminum and iron (e.g., steel, stainless steel, and cast iron). Any seal herein disclosed may be made of any suitable sealing material such as, but not limited to rubber, plastic, soft plastic and/or foam. Container 105 may include any suitable shape and design.

Figure 15A:
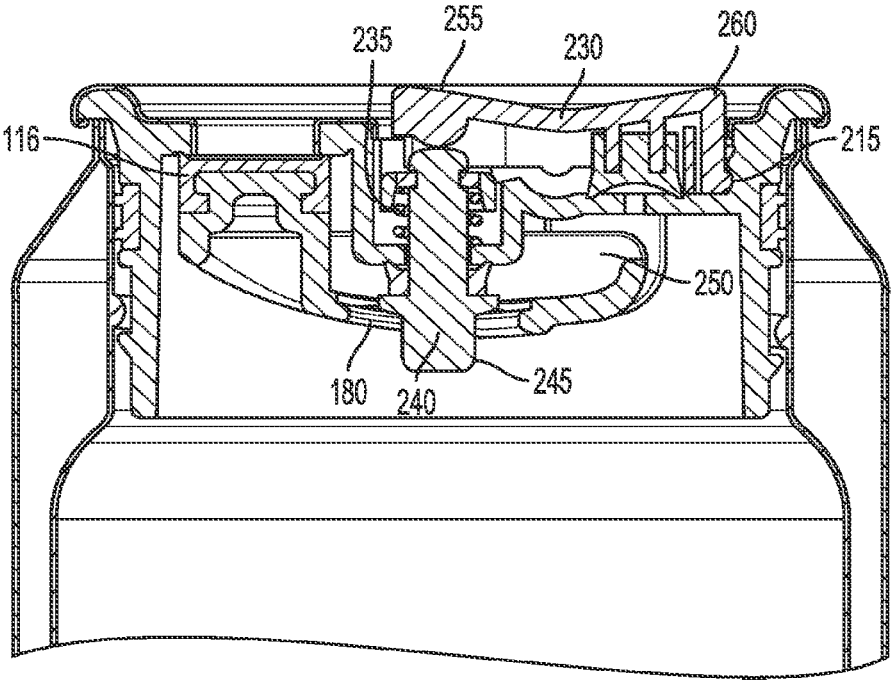
FIG. 15A provides a partial cross-sectional closed view of an exemplary embodiment of the invention.
Figure 15B:
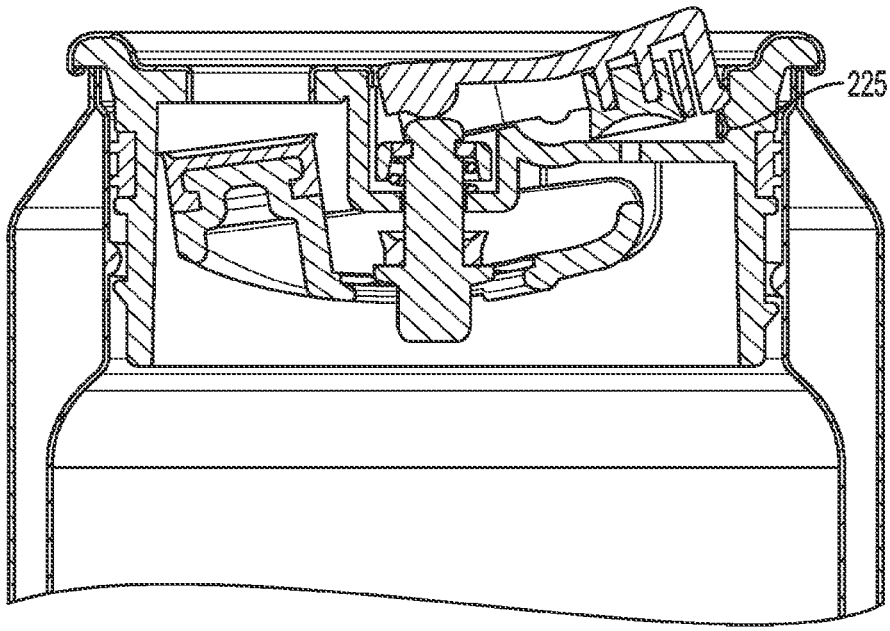
FIG. 15B provides a partial cross-sectional open view of an exemplary embodiment of the invention.

Now referring to FIGS. 15A and 15B, cross-sectional views of an alternative embodiment 229 of resealable closure mechanism 155 in a locked/sealed/closed, and open/unsealed position, respectively, are provided. In FIG. 15A, alternative embodiment 229 of resealable closure mechanism 155 is presented in a locked position. As seen more clearly in the cross-sectional view, rocker arm 180 is connected to push button 230 via actuator 140. In the closed view, mouthpiece plug 116 is engaged with the opening 115 to form a seal, thereby minimizing leakage.

In FIG. 15B, alternative embodiment 229 of resealable closure mechanism 155 is presented in an unlocked/open/unsealed position. Push button 230 may be depressed by the user on the linear actuator engaging end 255 such that spring 235 may be compressed, thereby locking actuator 240 in a downwards and linear fashion as detent 215 slides out of detent groove 225 to slot into a ridge groove on the top side of detent groove 225. In the cross-sectional open view, mouthpiece plug 116 may not be engaged with the opening 115, therefore allowing fluid from container 105 to be provided and/or accessed. The user may then depress push button 230 at the cap cover engaging end 260, thereby engaging the mouthpiece 116 with the opening 115 and locking the resealable closure mechanism 155.

Figure 16:
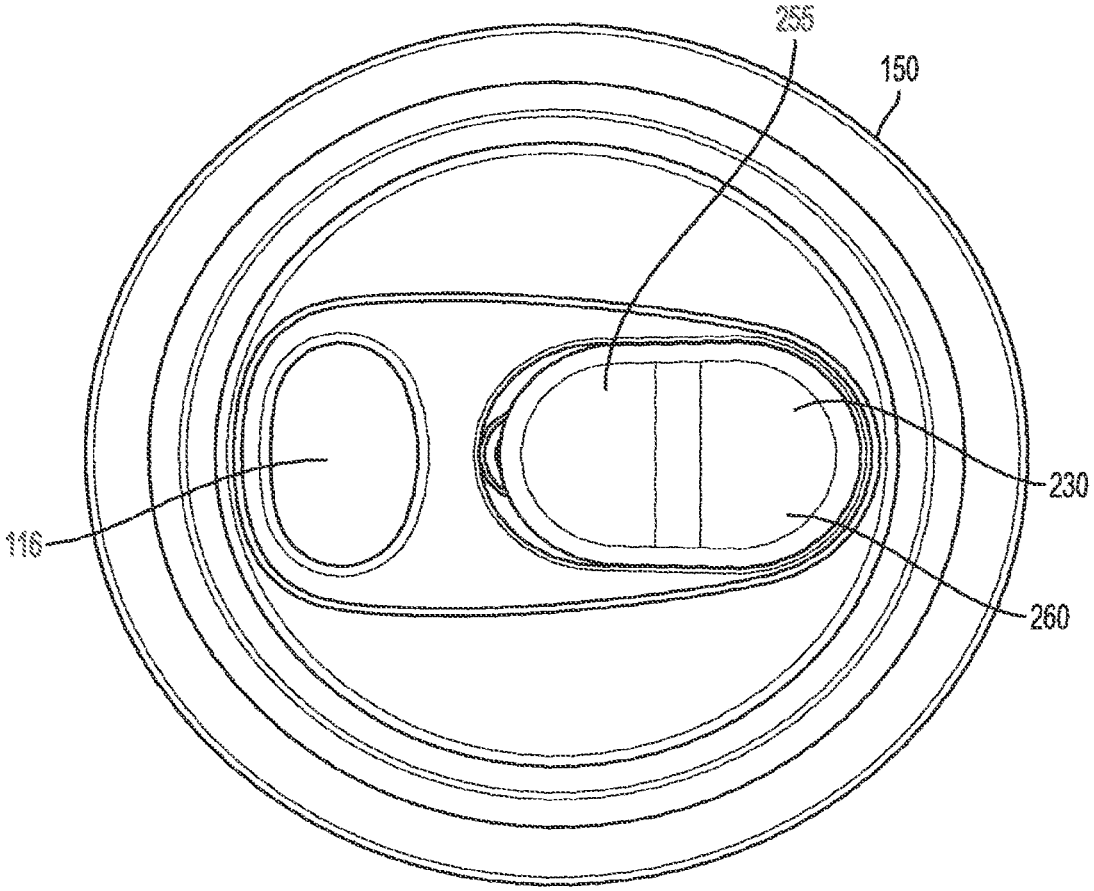
FIG. 16 provides a top view of an exemplary embodiment of the resealable container according to another embodiment of the invention.

Now referring to FIG. 16, a top view of alternative embodiment 229 is provided.

Figure 17:
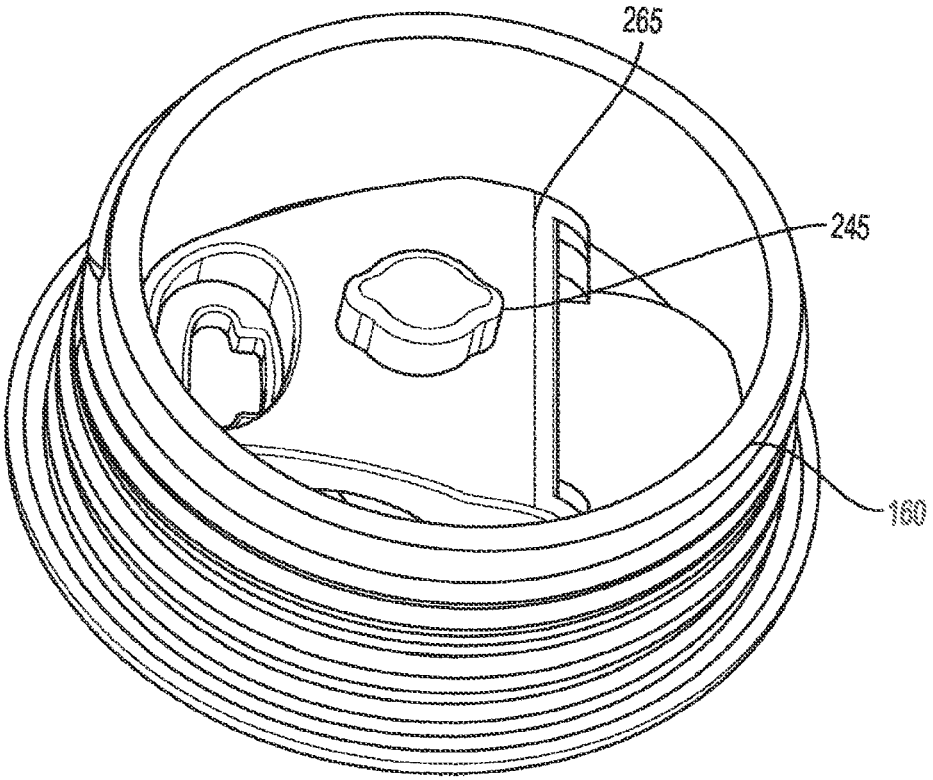
FIG. 17 provides a bottom perspective view of an exemplary embodiment of the invention.

Now referring to FIG. 17, a top view of alternative embodiment 229 of the present disclosure is provided.

Alternative embodiment 229 may include push button 230, cap cover plate 150, and mouthpiece cover 116.

EQUIVALENTS

Although preferred embodiments of the invention have been described using specific terms, such description is for illustrative purposes only, and it is to be understood that changes and variations may be made without departing from the spirit or scope of the following claims.

The invention claimed is:

1. A resealable cap for a container, comprising:

a cap cover having an opening; and a resealable closure mechanism including a push button tab, an actuator post, a spring, an O-ring, a rocker arm having a distal rocker arm end configured to resealably mate with the opening in the cap cover, and a locking cap member, wherein the actuator post passes through the cap cover and has a first end configured to interact with the push button tab and a second end configured to slide through the rocker arm and mate with the locking cap member, thereby retaining the rocker arm on the second end of the actuator post, and the spring and the O-ring are positioned on the actuator post between the rocker arm and the push button tab, wherein the push button tab comprises one of a detent or a ridge groove and a detent groove, wherein the grooves maintain the detent so that the rocker arm is either in an actuated position or an un-actuated position.

2. The resealable cap of claim 1, wherein the push button tab alternates between the actuated position and the un-actuated position.

3. The resealable cap of claim 1, wherein the distal end of the rocker arm is covered by a mouthpiece plug.

4. The resealable cap of claim 3, wherein the mouthpiece plug is made of a material selected from the group consisting of rubber, plastic, soft plastic, foam, and silicone.

5. The resealable cap of claim 1, wherein the push button tab includes the detent.

6. The resealable cap of claim 5, wherein the detent is configured to mate with the detent groove positioned in the cap cover when the push button tab is in the un-actuated position.

7. The resealable cap of claim 1, wherein the cap cover has a top edge configured to house the push button tab and a bottom edge configured to mate with a container.

8. The resealable cap of claim 1, wherein the spring has a first spring end that abuts a flanged portion of the first end of the actuator post and a second spring end that seats against a top portion of the cap cover.

9. The resealable cap of claim 8, wherein the spring is compressed when the push button tab is in the actuated position and uncompressed when the push button tab is in the un-actuated position.

10. The resealable cap of claim 9, wherein the distal rocker arm end is positioned away from the opening when the push button tab is in the actuated position and the spring is compressed.

* * * * *